US005388287A

United States Patent [19]

Tischler et al.

[11] Patent Number: 5,388,287

[45] Date of Patent: Feb. 14, 1995

[54] COUNTERTOP FAUCET ASSEMBLY

[75] Inventors: Edward J. Tischler, St. Paul; Marlin A. Frank, Minneapolis, both of Minn.; Kenneth J. Merchak, Hudson, Wis.

[73] Assignee: Ecowater Systems, Inc., Woodbury, Minn.

[21] Appl. No.: 90,430

[22] Filed: Jul. 12, 1993

[51] Int. Cl.[6] ..... E03C 1/02

[52] U.S. Cl. ..... 4/678; 4/695; 4/676; 137/359

[58] Field of Search ..... 4/675, 676, 677, 678, 4/695; 137/359, 360

[56] References Cited

U.S. PATENT DOCUMENTS

| | | | |
|---|---|---|---|
| 980,880 | 1/1911 | Mueller . | |
| 1,943,140 | 1/1934 | Niedecken . | |
| 2,302,273 | 11/1942 | Sutton . | |
| 2,461,354 | 2/1949 | Stone | 4/695 |
| 2,847,027 | 8/1958 | Kumpman . | |
| 2,851,286 | 9/1958 | Bishop . | |
| 2,872,246 | 2/1959 | Zierden . | |
| 3,023,767 | 3/1962 | Woodford . | |
| 3,158,169 | 11/1964 | Smith . | |
| 3,183,923 | 5/1965 | Henrikson . | |
| 3,411,524 | 11/1968 | Raine et al. . | |
| 3,427,049 | 2/1969 | Politz . | |
| 3,443,266 | 5/1969 | Mongerson et al. . | |
| 3,512,545 | 5/1970 | Weaver . | |
| 3,578,016 | 5/1971 | Kushner . | |
| 3,620,241 | 11/1971 | Brown . | |
| 3,669,141 | 6/1972 | Schmitt . | |
| 3,807,453 | 4/1974 | Dom et al. . | |
| 3,847,181 | 11/1974 | Scheiwer | 4/678 |
| 3,967,638 | 7/1976 | Tondreau . | |
| 4,134,419 | 1/1979 | Richetti . | |
| 4,210,533 | 7/1980 | Astl . | |
| 4,260,130 | 4/1981 | Brehm . | |
| 4,313,469 | 2/1982 | Johnson . | |
| 4,345,719 | 8/1982 | Bock . | |
| 4,356,574 | 11/1982 | Johnson . | |
| 4,407,023 | 10/1983 | Norton | 4/695 |
| 4,454,890 | 6/1984 | Schoenheimer et al. . | |
| 4,454,891 | 6/1984 | Dreibelvis et al. . | |
| 4,537,360 | 8/1985 | Bock . | |
| 4,552,171 | 11/1985 | Farrell et al. . | |
| 4,582,253 | 4/1986 | Gerdes . | |
| 4,635,673 | 1/1987 | Gerdes . | |
| 4,671,316 | 6/1987 | Botnick . | |
| 4,760,861 | 8/1988 | Botnick . | |
| 4,771,485 | 9/1988 | Traylor . | |
| 4,781,399 | 11/1988 | Collon . | |
| 4,843,395 | 7/1989 | Krippendorf . | |
| 4,856,121 | 8/1989 | Traylor | 4/678 |
| 4,967,784 | 11/1990 | Barhydt, Sr. et al. . | |
| 4,989,278 | 2/1991 | Kostorz . | |
| 4,998,555 | 3/1991 | Barhydt, Sr. et al. . | |
| 5,010,922 | 4/1991 | Agresta . | |
| 5,020,569 | 6/1991 | Agresta . | |
| 5,027,851 | 7/1991 | Drees et al. . | |

*Primary Examiner*—Henry J. Recla
*Assistant Examiner*—Charles R. Eloshway
*Attorney, Agent, or Firm*—Keck, Mahin & Cate; Jon Carl Gealow

[57] ABSTRACT

A countertop faucet assembly adapted to be secured over a hole in a countertop without requiring access to the area below the countertop. A base subassembly of the countertop faucet assembly is secured to the countertop and a faucet and cap assembly is thereafter secured to the base subassembly.

8 Claims, 1 Drawing Sheet

COUNTERTOP FAUCET ASSEMBLY

BACKGROUND OF THE INVENTION

I. Field of the Invention

This invention relates to a countertop faucet assembly adapted to be secured over a hole in a countertop without access being required to the area below the countertop.

II. Description of Related Art Including Including Information Disclosed Under Secs. 1.97–1.99

In addition to the hot and cold water faucets normally provided on a countertop adjacent a sink, an auxiliary faucet is frequently provided for an auxiliary water supply such as water hot enough for making coffee or tea, refrigerated water, or tap water which has been further processed to remove impurities and foreign tastes. In installing such auxiliary faucets, it is highly desirable to be able to secure the faucet over a hole in the counter without it being necessary to install a first portion of the securing means from below the counter and another portion from above the counter. With it being possible to secure the faucet from above the counter, it makes it much easier for one person to install the faucet, greatly decreasing the amount of labor involved in installing the faucet.

The desirability of being able to secure accessory faucets to a countertop without need for access to the area under the counter has been previously recognized. The following patents disclose prior arrangements in which a faucet may be secured over a hole in a surface without access being required to the opposite side of the surface for securing purposes.

| U.S. Pat. No. | Inventor |
|---|---|
| 3,669,141 | Schmitt |
| 4,356,574 | Johnson |
| 4,635,673 | Gerdees |
| 4,760,861 | Botnick |
| 4,848,395 | Krippendorf |
| 4,967,784 | Barhydt, Sr., et al. |
| 4,998,555 | Barhydt, Sr., et al. |
| 5,010,922 | Agresta |

The Schmitt and Johnson patents reveal faucet mounting arrangement's wherein a clamping member drawn up against the bottom of the counter is provided with a pair of holes, such that a first fastening member can be secured in one of the holes and a second fastening member in the other of the holes. The clamping member is inserted through one of the holes, using a first securing member as a handle, and then rotated such that the second securing member may be secured in the second hole in the clamping member. The Botnick patent reveals a faucet manifold which is mounted over an opening in a countertop and secured thereto by the use of toggle bolts. The Krippendorf patent reveals an arrangement for mounting a mixing faucet in which a step sleeve has a pair of holes therein which receive clamping screws. The clamping screws are provided with lugs which can be rotated to a first position to pass through the a hole in the counter and then rotated to engage the undersurface of the counter adjacent the hole. The Barhydt, Sr. et al patents and the Agresta patent all reveal a similar mounting arrangement wherein a plate, positioned over a hole in a counter, is provided with two holes therein for receiving bolts which engage clamping nuts. The clamping nuts are brought into engagement with the undersurface of the counter by rotated them with a finger extended through the hole in the counter. The bolts are turned to bring the clamping nuts into tight engagement with the undersurface of the counter. While two clamping nuts are shown as elongated members with upturned ends, the patent only suggests how one of the clamping nuts may be rotated by extending a finger through the hole in the counter to position it under the counter. There is no teaching of how the second nut is to be positioned under the counter. Finally, the Gerdes patent reveals still another arrangement for securing an accessory faucet over a hole in a counter without access to the area under the counter. A mounting nut having a readily collapsible/expandable portion is passed downwardly through a hole in the sink lip. The portion thereafter expands, such that it will no longer pass through the hole, thus securing the faucet to the counter.

SUMMARY OF THE INVENTION

It is an object of this invention to provide a countertop faucet assembly the base of which may be secured to the countertop without requiring access to the area below the countertop. It is a further object to provide an assemble arrangement in which a faucet may be secured to the base without the use of any tools. It is a further object of this invention to provide a countertop faucet assembly with a base subassembly which may be readily secured to the countertop with a minimum amount of work, performed from above the countertop. It is a still further object of the invention to provide an arrangement wherein a base subassembly having been secured to the countertop, a faucet and cap assembly may be readily secured to thereto without the use of tools.

In accordance with this invention, a countertop faucet assembly is formed of two subassemblies, a base subassembly and a faucet and cap subassembly. The base subassembly includes a base member provided with an aperture therein which is aligned with the hole in the counter, and which is secured to the top of the counter from above the counter. A pair of tabs or projections extend into the aperture, with one of the tabs or projections having an aperture therein for receiving a first tightening means and the other of the tabs or projections having a slot therein for receiving a second tightening means. The first tightening means or bolt with a clamping means attached thereto is passed through the hole in the counter and the clamping means then positioned to engage the undersurface of the counter, such that when the tightening means or bolt is tightened with respect to the clamping means, the base subassembly is partially secured to the countertop. The second tightening means with a clamping means attached thereto is inserted in the slot with the clamping means positioned to engage the undersurface of the counter. Again, when the second tightening means or bolt is tightened with respect to the clamping means, the base subassembly is secured to the countertop. The base subassembly is provided with a first portion of at least one attachment means and the faucet and cap subassembly is provided with a second portion of the at least one attachment means. By positioning the faucet and cap subassembly over the base subassembly and bringing them into engagement, the first and second portions of the attachment means engage each other to secure the faucet and cap subassembly to the base subassembly.

DETAILED DESCRIPTION OF THE PREFERRED EMBODIMENT

Figure 1:
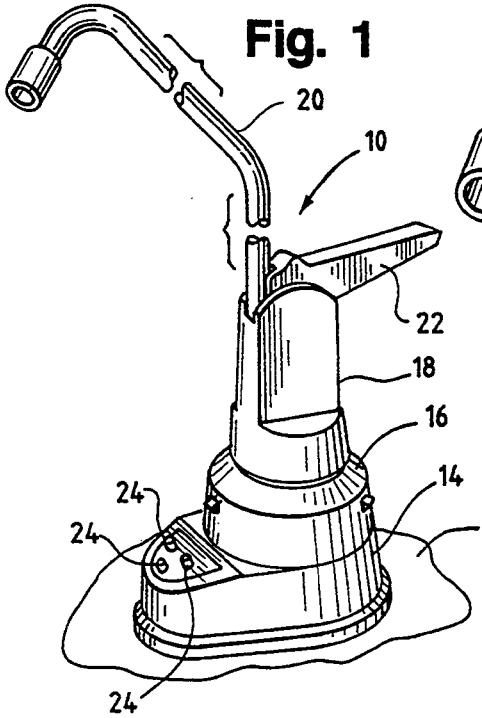
FIG. 1 is a perspective view of a countertop faucet assembly in accordance with this invention, mounted on a countertop.

Referring to FIG. 1, a countertop faucet assembly 10 in accordance with this invention is shown secured to a countertop 12. Countertop 12 in certain applications could be a portion of a sink. As shown in FIG. 1, a base 14 is secured to the countertop 12 and a cap member 16 is in turn secured to the base member 14. Extending from the cap 16 is a support member 18 for a faucet stem 20 and a valve control lever 22. In accordance with one embodiment of this invention, illuminated indicators 24 are provided on the base 14 for purposes of indicating the operating condition of the system providing water to the faucet.

Figure 2:
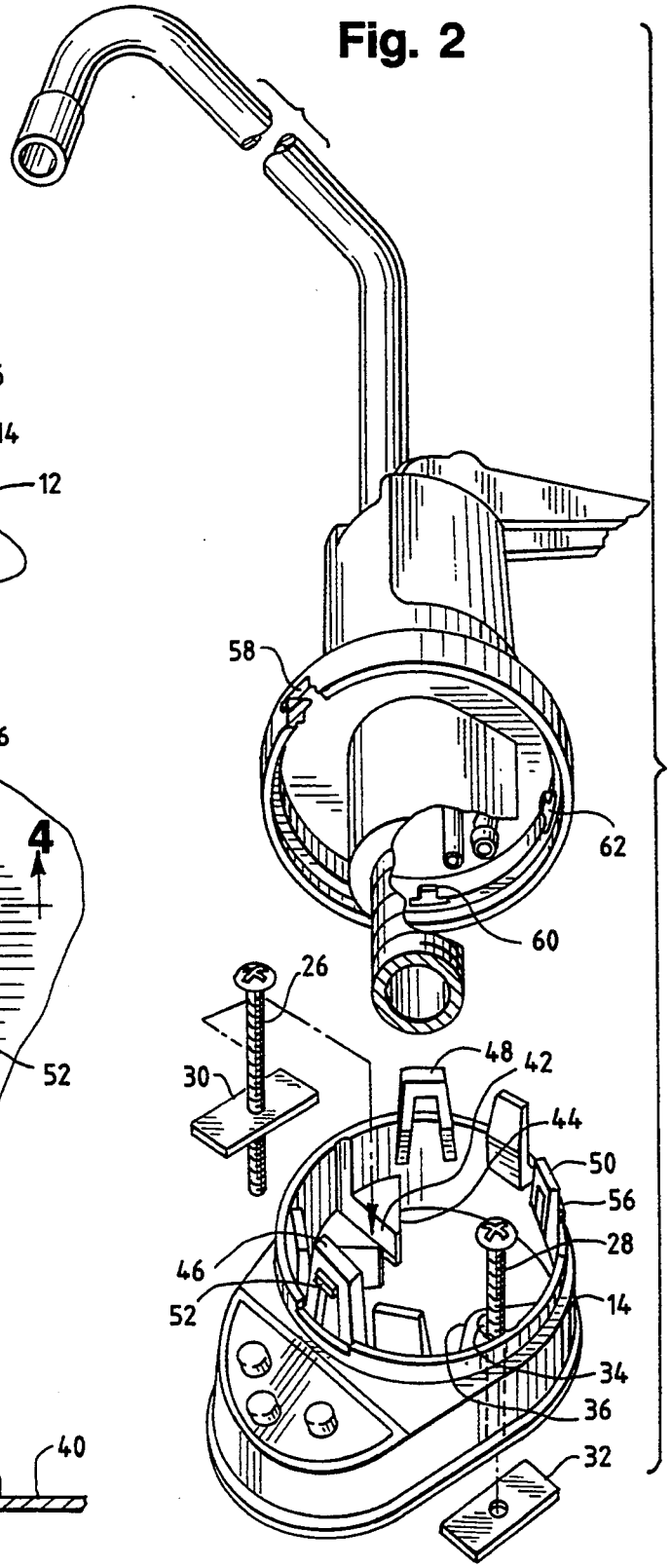
FIG. 2 is an exploded view of the countertop faucet assembly shown in FIG. 1.
Figure 4:
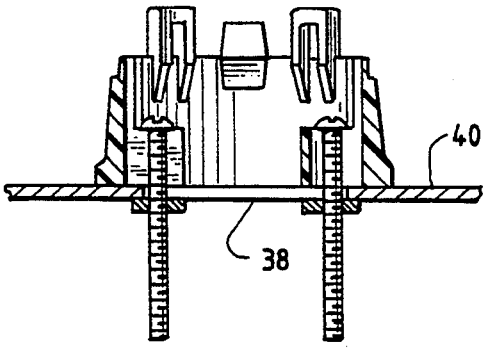
FIG. 4 is a cross-section of the base subassembly taken along the lines 4—4 in FIG. 3.

Referring to FIG. 2, a base subassembly includes in addition to the base member 14, a pair of tightening means 26 and 28 which are preferably bolts. Engaged by the bolts 26 and 28 are a pair of clamping means 30 and 32. The clamping means 30 and 32 are formed as rectangular sheet metal pieces having a threaded aperture in the center thereof. The first bolt 28 is passed through a hole 34 formed in a first tab 36 formed integrally with the base and projecting into the aperture or hole formed in the center of the base. After the bolt 28 is passed through the aperture 34, it is threaded into the clamping means or plate 32. In securing the base member 14 over a hole or aperture 38 in a countertop, the clamping plate 32 is inserted through the aperture 38 in the counter 40 as shown in FIG. 4 with the clamping plate rotated to engage the undersurface of the counter. The clamping plate 30 is partially threaded onto the bolt 26, and plate 30 is passed through the hole in the center of the base 14 and through the hole 38 in the counter. The bolt 26 is then is slid into a slot 42 formed in a second tab 44 extending into the aperture in the base 14, and is then positioned such that the clamping plate 30 engages the undersurface of the counter 40, as shown in FIG. 4.

With both of the clamping plates 30 and 32 positioned to engage the undersurface of the counter 40, bolts 26 and 28 are rotated such as by the use of a Phillips screwdriver to squeeze the countertop 40 between the base 14 and the clamping plates 30 and 32.

Figure 3:
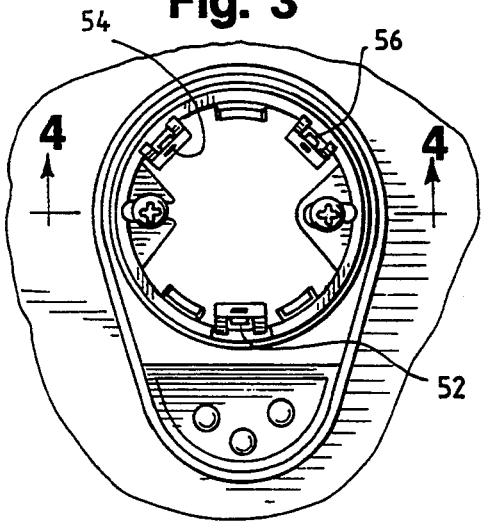
FIG. 3 is a top plan view of the base subassembly of the countertop faucet assembly shown in FIG. 1.

With the base 14 secured to the countertop 40 as shown in FIGS. 3 and 4, access to the bolts 26 and 28 is no longer needed nor desirable since it detracts from the appearance of the faucet. Referring again to FIGS. 2–4, it will be seen that the base 14 is provided with three upwardly projecting first portions of three attachment means in the form of upwardly projecting fingers 46, 48 and 50. Each of these fingers is provided with an outwardly projecting tab 52, 54 and 56 respectively. As shown in FIG. 2, the base of a cap 16 is formed as a hollow cylindrical surface, which is provided with three second portions of the three attachment means in the form of notches or apertures 58, 60 and 62. These apertures are positioned to receive the tabs 52, 54, and 56 when the cap 16 is forced downwardly over the base 14. The projections or fingers 46, 48 and 50 are resilient to the extent that they are deflected inwardly as the cap 16 is passed downwardly over them. The tabs 52, 54 and 56 are positioned in alignment with the notches or apertures 58, 60 and 62. The tabs will be resiliently biased into the notches by the fingers, thus securing the cap 16 and attached faucet and handle support 18 to the base. It will be noted that the fingers 46, 48 and 50 are unequally positioned around the cap 16, such it may only be installed in one position on the base.

While one embodiment of the invention has been shown, it should be apparent to those skilled in the art that what has been described is considered at present to be the preferred embodiment of the countertop faucet assembly of this invention. In accordance with the patent statute, changes may be made in the unit without actually departing from the true spirit and scope of this invention. The appended claims are intended to cover all such changes and modifications which fall in the true spirit and scope of this invention.

What is claimed is:

1. A countertop faucet assembly adapted to be secured over a hole in a countertop having upper and lower surfaces, with connections to said faucet passing through said hole, said assembly being secured to said countertop without access being required to an area below the countertop, said assembly comprising, a base subassembly including, a base member having an aperture formed therein through which the connections to the faucet pass, said base member provided with a first tab projecting into said aperture, said first tab having a hole therein, said base member provided with a second tab projecting into said aperture, said second tab having a slot therein, a side of which slot opens into said aperture, a first tightening means received in said hole in said first tab, said first tightening means having a first clamping means attached thereto, such that when said base member is placed over the hole in the countertop, said first clamping means may be positioned to engage the lower surface of the countertop and said first tightening means actuated to cause said base member and said first clamping means to be drawn together against opposite sides of said countertop to partially secure said base member to the countertop, a second tightening means received in said slot in said second tab through said side which opens into said aperture, said second tightening means having a second clamping means attached thereto, such that when said base member is partially secured to said countertop, said second tightening means may be positioned in said slot, and said second clamping means positioned to engage the lower surface of said countertop and said second tightening means actuated to cause said base member and said second clamping means to be drawn together against opposite sides of said countertop to secure said base member to said countertop, a faucet and cap subassembly, at least one attachment means for attaching said faucet and cap subassembly to said base member, a first portion of said attachment means being provided on said base member and a second portion of said attachment means being provided on said faucet and cap subassembly, said first and second portions of said attachment means engaging each other when said faucet and cap assembly is brought into engagement with said base member, so as to retain and secure said faucet and cap subassembly to said base member, whereby said countertop faucet assembly is secure to said countertop.

2. The countertop faucet assembly of claim 1, wherein said first and second tightening means are bolts, said bolts having heads which are accessible for rotation of said bolts from above the countertop for securing said countertop assembly over the hole in the countertop.

3. The countertop faucet assembly of claim 2, wherein said first and second .clamping means are provided with a threaded hole for receiving threaded portions of said bolts.

4. The countertop faucet assembly of claim 1, wherein said first portion of said attachment means is a tab, and said second portion of said attachment means is a notch, wherein said tab is engaged in said notch to secure said faucet and cap subassembly to said base member.

5. The countertop faucet assembly of claim 4, wherein said base member, said first and second tabs, and said tab are integrally formed.

6. The countertop faucet assembly of claim 5, wherein said base member is formed as an integrally molded piece.

7. The countertop faucet assembly of claim 6, wherein said aperture has a cylindrical periphery, and three attachment means are provided around the periphery of said aperture and are spaced from each other so as to provide for a predetermined alignment of said base subassembly and said faucet and cap subassembly when the subassemblies are secured to each other by said attachment means.

8. The countertop faucet assembly of claim 1, wherein indicating means are mounted in said base member so as to indicate an operating condition of a system supplying a fluid to said faucet assembly.

* * * * *